US009113683B2

(12) United States Patent
Ma

(10) Patent No.: US 9,113,683 B2
(45) Date of Patent: Aug. 25, 2015

(54) UMBRELLA

(71) Applicant: Oliver Joen-an Ma, Arcadia, CA (US)

(72) Inventor: Oliver Joen-an Ma, Arcadia, CA (US)

( * ) Notice: Subject to any disclaimer, the term of this patent is extended or adjusted under 35 U.S.C. 154(b) by 0 days.

(21) Appl. No.: 13/657,344

(22) Filed: Oct. 22, 2012

(65) Prior Publication Data

US 2014/0109942 A1 Apr. 24, 2014

(51) Int. Cl.
*A45B 25/08* (2006.01)
*A45B 25/16* (2006.01)
*A45B 25/14* (2006.01)

(52) U.S. Cl.
CPC ..... *A45B 25/08* (2013.01); *A45B 25/14* (2013.01); *A45B 25/16* (2013.01)
USPC ..... 135/28; 135/39; 135/41

(58) Field of Classification Search
CPC ..... A45B 25/02; A45B 25/06; A45B 25/08; A45B 25/14; A45B 25/16
USPC ..... 135/28–29, 37–41, 22–23
See application file for complete search history.

(56) References Cited

U.S. PATENT DOCUMENTS

| | | | | |
|---|---|---|---|---|
| 526,155 | A * | 9/1894 | Kimball | 135/41 |
| 878,270 | A | 2/1908 | Blake et al. | |
| 956,657 | A | 5/1910 | Wetteroth | |
| 957,528 | A | 5/1910 | Wetteroth | |
| D45,227 | S | 2/1914 | Glauber | |
| 1,136,887 | A | 4/1915 | Penn | |
| 1,235,296 | A | 7/1917 | Dillingham | |
| 1,243,594 | A | 10/1917 | Dillingham | |
| 1,255,627 | A | 2/1918 | Morrow et al. | |
| 1,268,354 | A | 6/1918 | Howard | |
| 1,801,913 | A | 4/1931 | Frederick | |
| D90,772 | S | 9/1933 | Kasch | |
| D127,735 | S | 6/1941 | Dreyfuss | |
| 2,447,972 | A | 8/1948 | Weinert | |
| 2,475,406 | A | 7/1949 | Russell | |
| D162,678 | S | 3/1951 | Muller-Munk | |
| D167,619 | S | 9/1952 | Coran | |
| 2,745,421 | A | 5/1956 | Russell | |
| 2,762,383 | A | 9/1956 | Wittman | |
| 2,937,653 | A | 5/1960 | Danciart et al. | |
| D190,597 | S | 6/1961 | Nelson | |
| 3,120,238 | A | 2/1964 | Glatz | |
| 3,145,720 | A | 8/1964 | Torii | |
| 3,424,180 | A * | 1/1969 | Andolfi | 135/28 |
| 3,856,032 | A | 12/1974 | Schafer | |

(Continued)

FOREIGN PATENT DOCUMENTS

| | | |
|---|---|---|
| BG | 6965-0001 | 4/2009 |
| CN | 202190859 | 4/2012 |

(Continued)

OTHER PUBLICATIONS

Operation Manual Easy Sun Parasol Sunshade (Issue: Jul. 2004) pp. 1-17.

*Primary Examiner* — Winnie Yip
(74) *Attorney, Agent, or Firm* — Knobbe Martens Olson & Bear, LLP

(57) ABSTRACT

Umbrella assemblies described herein are advantageously configured with simple yet robust arrangements for securing an umbrella in an open configuration, for example, with a runner in an elevated position. In some embodiments, the umbrella assemblies are self-opening and/or include locking devices. The locking devices can engage support structures positioned on an umbrella pole.

17 Claims, 8 Drawing Sheets

(56) References Cited

U.S. PATENT DOCUMENTS

| | | | | |
|---|---|---|---|---|
| D265,498 | S | 7/1982 | Paul | |
| 4,368,749 | A | 1/1983 | Lindler et al. | |
| D276,838 | S | 12/1984 | Hill et al. | |
| 4,586,525 | A | 5/1986 | Glatz et al. | |
| 4,610,262 | A * | 9/1986 | Broyer et al. | 135/23 |
| 4,622,987 | A | 11/1986 | Redl et al. | |
| 4,674,523 | A | 6/1987 | Glatz | |
| 4,811,670 | A | 3/1989 | Kolvites et al. | |
| 4,878,509 | A | 11/1989 | Tung | |
| 4,993,445 | A | 2/1991 | Dubinsky | |
| 5,002,081 | A | 3/1991 | Stromeyer | |
| 5,020,557 | A | 6/1991 | Apple | |
| 5,029,596 | A | 7/1991 | Tung | |
| 5,050,627 | A | 9/1991 | Hengtzu | |
| 5,174,319 | A | 12/1992 | Chou et al. | |
| 5,284,171 | A | 2/1994 | Liu | |
| D344,786 | S | 3/1994 | Short et al. | |
| 5,349,975 | A | 9/1994 | Valdner | |
| 5,355,903 | A | 10/1994 | Haddad et al. | |
| 5,357,994 | A | 10/1994 | Chung | |
| 5,499,644 | A | 3/1996 | Geniele | |
| D372,854 | S | 8/1996 | Jimenez | |
| 5,584,564 | A | 12/1996 | Phyle | |
| 5,588,455 | A | 12/1996 | Kuo | |
| 5,611,364 | A | 3/1997 | Woods et al. | |
| 5,615,698 | A | 4/1997 | Ko | |
| 5,640,984 | A | 6/1997 | Dubunsky | |
| 5,655,557 | A | 8/1997 | Martin | |
| 5,740,823 | A | 4/1998 | Lin et al. | |
| 5,740,824 | A * | 4/1998 | Tang | 135/28 |
| 5,749,386 | A | 5/1998 | Samuel, Jr. | |
| 5,785,069 | A | 7/1998 | Glatz | |
| D397,054 | S | 8/1998 | Brantley et al. | |
| D398,443 | S | 9/1998 | Bolle | |
| 5,809,734 | A | 9/1998 | Turner | |
| D400,777 | S | 11/1998 | Carsello | |
| 5,836,328 | A | 11/1998 | Lee | |
| 5,871,024 | A | 2/1999 | Vanderminden, Sr. | |
| 5,884,645 | A | 3/1999 | Chen et al. | |
| D408,621 | S | 4/1999 | Kuo | |
| 5,899,210 | A | 5/1999 | Letherby et al. | |
| D410,862 | S | 6/1999 | Milhov | |
| 5,937,882 | A | 8/1999 | Harbaugh | |
| 6,014,980 | A | 1/2000 | Glatz | |
| D434,215 | S | 11/2000 | Lin | |
| D434,476 | S | 11/2000 | Meda | |
| 6,145,523 | A | 11/2000 | Lo | |
| 6,152,156 | A | 11/2000 | Tung | |
| D434,556 | S | 12/2000 | Lin | |
| 6,192,907 | B1 * | 2/2001 | Wu | 135/28 |
| 6,220,261 | B1 | 4/2001 | Glatz | |
| 6,230,728 | B1 | 5/2001 | Reese | |
| 6,247,483 | B1 | 6/2001 | Tung | |
| 6,305,394 | B1 | 10/2001 | Reese | |
| 6,311,705 | B1 | 11/2001 | Ma | |
| 6,311,707 | B1 | 11/2001 | Wu et al. | |
| 6,314,976 | B1 | 11/2001 | Clarke | |
| 6,371,141 | B1 * | 4/2002 | Lin et al. | 135/28 |
| 6,371,686 | B1 | 4/2002 | Wu | |
| 6,386,214 | B1 | 5/2002 | Clarke | |
| 6,386,215 | B1 | 5/2002 | Chang | |
| 6,397,866 | B1 * | 6/2002 | You | 135/23 |
| 6,412,506 | B1 | 7/2002 | Reese | |
| 6,422,251 | B1 | 7/2002 | Tseng | |
| 6,478,037 | B2 | 11/2002 | Tung | |
| 6,571,813 | B2 | 6/2003 | Lin et al. | |
| 6,575,182 | B2 | 6/2003 | Tung | |
| 6,575,183 | B2 | 6/2003 | Tung | |
| D477,458 | S | 7/2003 | Goldwitz | |
| 6,588,438 | B1 | 7/2003 | Steiner | |
| 6,595,225 | B2 * | 7/2003 | Chuang et al. | 135/31 |
| D478,416 | S | 8/2003 | Clarke | |
| 6,619,306 | B2 | 9/2003 | Ma | |
| 6,662,815 | B2 | 12/2003 | Tung | |
| 6,732,753 | B2 | 5/2004 | Chang | |
| 6,758,229 | B2 * | 7/2004 | Wang | 135/41 |
| D497,478 | S | 10/2004 | Clarke | |
| D497,479 | S | 10/2004 | Yu | |
| 6,810,895 | B2 | 11/2004 | Lin et al. | |
| 6,837,255 | B2 | 1/2005 | Bunch et al. | |
| 6,848,459 | B2 | 2/2005 | Ma | |
| 6,851,823 | B2 | 2/2005 | Bilotti | |
| D503,035 | S | 3/2005 | Ko | |
| 6,889,699 | B2 | 5/2005 | Clarke | |
| 6,920,887 | B2 | 7/2005 | Lo | |
| 6,941,960 | B2 | 9/2005 | Huang | |
| 7,000,624 | B2 | 2/2006 | Chang | |
| D525,721 | S | 7/2006 | Landes | |
| 7,082,953 | B2 | 8/2006 | Liu | |
| 7,089,950 | B2 * | 8/2006 | Lin et al. | 135/38 |
| D539,632 | S | 4/2007 | Ma | |
| 7,281,542 | B2 | 10/2007 | Ko | |
| 7,293,573 | B2 | 11/2007 | Clarke | |
| D558,444 | S | 1/2008 | Ma | |
| 7,318,444 | B2 | 1/2008 | Clakre | |
| 7,328,715 | B2 | 2/2008 | Neubardt | |
| 7,546,845 | B2 | 6/2009 | Prusmack | |
| 7,600,734 | B2 | 10/2009 | Clarke | |
| 7,665,477 | B1 | 2/2010 | Hathaway | |
| 7,686,024 | B1 | 3/2010 | Lai | |
| 7,703,464 | B2 | 4/2010 | Ma | |
| 7,775,226 | B2 | 8/2010 | MacDonald et al. | |
| 7,806,130 | B2 * | 10/2010 | Gobel | 135/28 |
| D631,243 | S | 1/2011 | Forthuber et al. | |
| 7,861,734 | B2 | 1/2011 | Ma | |
| 7,891,367 | B2 | 2/2011 | Ma | |
| 7,900,643 | B2 | 3/2011 | Ma | |
| 7,913,708 | B2 | 3/2011 | Yung | |
| 7,913,709 | B2 | 3/2011 | Brebner | |
| D637,388 | S | 5/2011 | You | |
| D640,464 | S | 6/2011 | Forthuber et al. | |
| 7,980,262 | B1 | 7/2011 | You | |
| 8,061,375 | B2 | 11/2011 | Ma | |
| D650,984 | S | 12/2011 | Pineda | |
| 8,082,935 | B2 | 12/2011 | Ma | |
| 8,096,310 | B2 | 1/2012 | Clarke | |
| 8,424,547 | B1 * | 4/2013 | Ma et al. | 135/40 |
| 8,443,819 | B2 | 5/2013 | Beaulieu | |
| 2002/0083969 | A1 | 7/2002 | Tung | |
| 2002/0139405 | A1 | 10/2002 | Lee | |
| 2003/0010367 | A1 | 1/2003 | Ko | |
| 2003/0015230 | A1 | 1/2003 | Glatz | |
| 2003/0062073 | A1 | 4/2003 | Tung | |
| 2004/0031513 | A1 | 2/2004 | Bunch et al. | |
| 2004/0055627 | A1 | 3/2004 | Moga | |
| 2004/0055628 | A1 | 3/2004 | Yu | |
| 2004/0069333 | A1 | 4/2004 | Ma | |
| 2004/0154525 | A1 | 8/2004 | Wirth et al. | |
| 2004/0182429 | A1 | 9/2004 | Chen | |
| 2004/0206382 | A1 | 10/2004 | Clarke | |
| 2004/0206383 | A1 | 10/2004 | Clarke | |
| 2005/0098200 | A1 * | 5/2005 | Su | 135/38 |
| 2006/0005867 | A1 | 1/2006 | Chang | |
| 2006/0151019 | A1 | 7/2006 | Lo | |
| 2008/0202570 | A1 | 8/2008 | Clarke | |
| 2010/0139724 | A1 | 6/2010 | Lai | |
| 2010/0139725 | A1 | 6/2010 | Lai | |
| 2011/0061694 | A1 | 3/2011 | Vanderminden, Sr. | |
| 2011/0132418 | A1 | 6/2011 | Ma | |
| 2011/0155194 | A1 * | 6/2011 | Liu | 135/31 |
| 2011/0209732 | A1 | 9/2011 | Ma | |
| 2011/0214705 | A1 | 9/2011 | Ma | |
| 2011/0277800 | A1 | 11/2011 | Tung | |

FOREIGN PATENT DOCUMENTS

| | | | |
|---|---|---|---|
| DE | 3820573 | 8/1989 | |
| EP | 0 628 264 | 12/1994 | |
| EP | 1 510 145 | 3/2005 | |
| FR | 2672781 | 8/1992 | |
| FR | 2672781 A3 * | 8/1992 | A45B 25/14 |
| JP | 2006-110317 | 4/2006 | |
| JP | 2006110317 A * | 4/2006 | |
| JP | 2007-222591 | 9/2007 | |

(56) References Cited

FOREIGN PATENT DOCUMENTS

| | | | | | |
|---|---|---|---|---|---|
| JP | 2007222591 | A | * | 9/2007 | |
| JP | 2008-142310 | | | 6/2008 | |
| JP | 2008142310 | A | * | 6/2008 | |
| WO | WO 2005/058089 | | | 6/2005 | |
| WO | WO 2005058089 | A1 | * | 6/2005 | ..... A45B 25/06 |
| WO | WO 2007/092514 | | | 8/2007 | |

* cited by examiner

UMBRELLA

BACKGROUND OF THE INVENTION

1. Field of the Invention

This application is directed to an umbrella assembly that can include an umbrella frame and optionally a canopy.

2. Description of the Related Art

Umbrellas generally include ribs, a runner, and struts extending therebetween. The runner travels up to an elevated position to open the ribs and stretch a canopy that overlays the ribs and travels down to close the ribs and collapse the umbrella. The umbrella generally will collapse unless the runner is supported in the elevated position. Devices to support the runner in the elevated position range from a simple push-button detent arrangement to more complex rope and cleat mechanisms. A disadvantage of the former is that if the umbrella is large for use in a marketplace or to cover a significant area in a yard, the detent arrangement may not be strong enough to support the weight or may be difficult to directly manipulate. On the other hand, rope and cleat mechanisms can support a lot of weight but they add cost and complexity.

SUMMARY

This application relates to an umbrella assembly. The umbrella assembly includes a pole, an upper hub, and a runner. The pole has an upper end and a lower end. The upper hub is coupled with the upper end of the pole. The runner is disposed beneath the upper hub and is coupled with the pole to slide between a lower position in which the umbrella is closed and an upper position in which the umbrella is open. A support structure is disposed on the pole. A locking device is mounted on the runner, the locking device is configured to engage the support structure to maintain the runner in the upper position and to disengage from the support structure to permit the runner to slide from the upper position to the lower position.

In another embodiment, an umbrella assembly is provided that includes a pole, an upper hub, and a runner. The runner is disposed beneath the upper hub and coupled with the pole to slide between a lower position and an upper position. The umbrella assembly includes a plurality of support members, which can include struts, ribs, or a combination of struts and ribs or other rigid members. For example, a plurality of ribs can be coupled with the upper hub and a plurality of struts can extend between the ribs and the runner. The umbrella has an open configuration in which the runner is elevated and a closed configuration in which the runner is lowered. The umbrella has an inflection point along the travel of the runner between the closed configuration and the open configuration. The inflection point corresponds to a point or location where the net forces applied by the support members to the runner switches direction from a downward net force to an upward net force.

Umbrella assemblies described herein are advantageously configured to simplify securing an umbrella in an open configuration, e.g., with a runner in an elevated position.

Some embodiments provide integrated actuatable locking devices that can be disengaged by direct action on the locking device.

Other embodiments provide for indirect action on a locking device, for example, by moving an actuator, e.g., a sliding collar disposed above or around the locking device.

Other embodiments provide for securing a runner without any actuatable mechanism, but rather by incorporating an inflection point along the travel of the runner beyond which the runner automatically moves from the position corresponding to the inflection point to a position corresponding to the umbrella being fully open, e.g., to an elevation above the elevation of the locking position.

BRIEF DESCRIPTION OF THE DRAWINGS

These and other features, aspects and advantages are described below with reference to the drawings, which are intended to illustrate but not to limit the inventions. In the drawings, like reference characters denote corresponding features consistently throughout similar embodiments.

DETAILED DESCRIPTION OF EMBODIMENTS

While the present description sets forth specific details of various embodiments, it will be appreciated that the description is illustrative only and should not be construed in any way as limiting. Furthermore, various applications of such embodiments and modifications thereto, which may occur to those who are skilled in the art, are also encompassed by the general concepts described herein.

Figure 1:
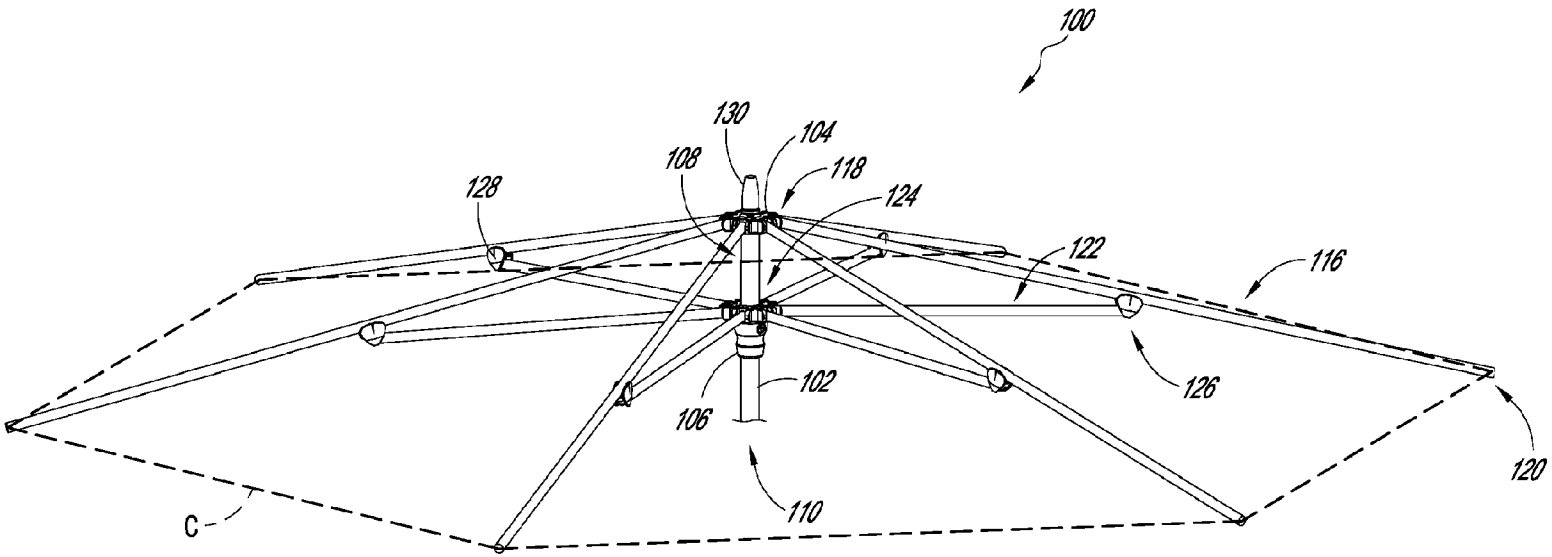
FIG. 1 is a side perspective view of an umbrella frame and pole assembly for an umbrella.
Figure 2:
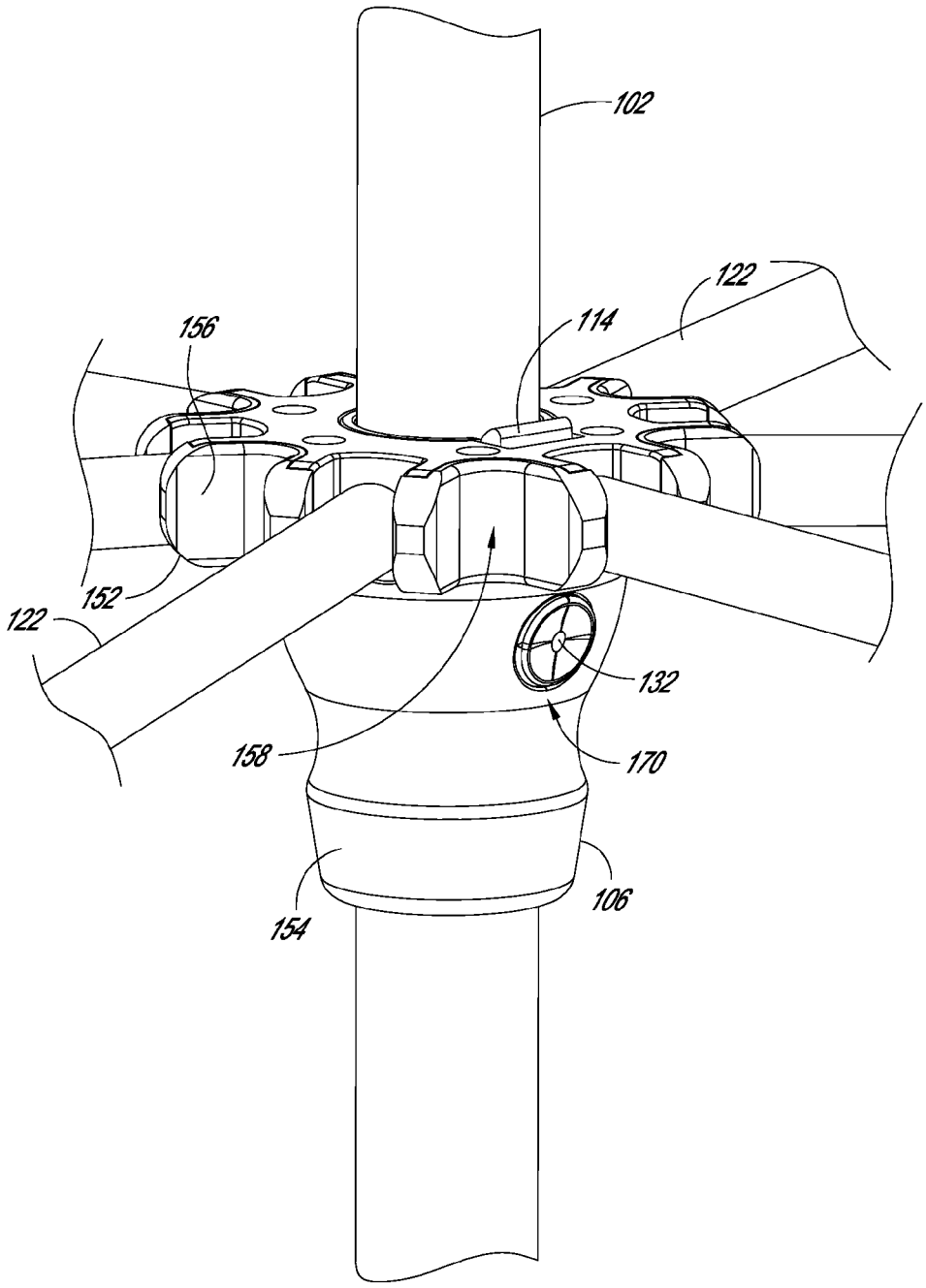
FIG. 2 is a side perspective view of an umbrella runner of the umbrella frame and pole assembly of FIG. 1.
Figure 3:
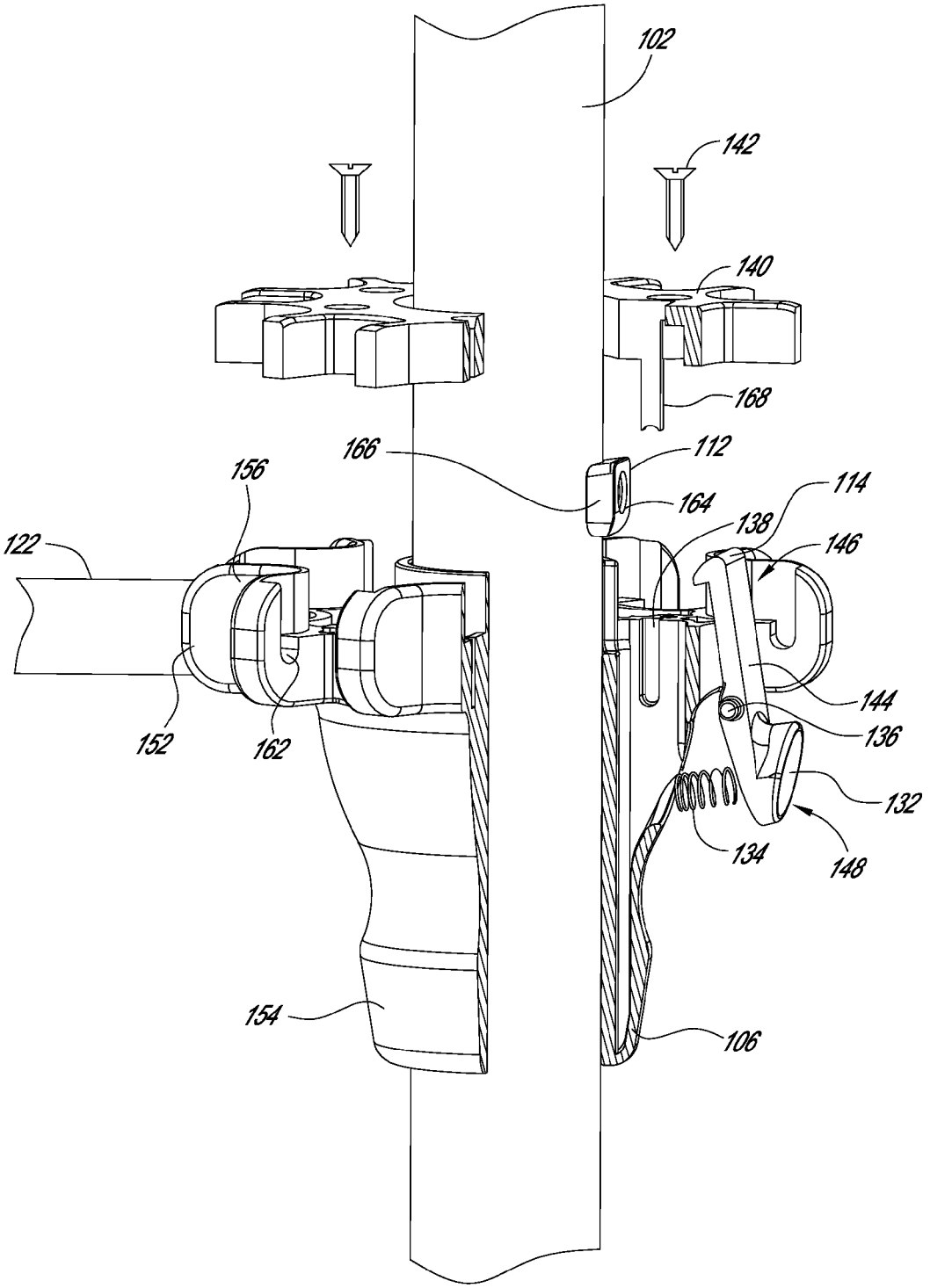
FIG. 3 is an exploded view of the runner of FIG. 2.

This application relates to an umbrella assembly. FIG. 1 illustrates an embodiment of an umbrella or umbrella assembly 100. The umbrella assembly 100 can comprise a pole 102, an upper hub 104, and a lower hub or runner 106. The pole 102 can comprise an upper end 108 and a lower end 110. The upper hub 104 can be configured to be coupled with the upper end 108 of the pole 102. The runner 106 can be disposed beneath the upper hub 104 and configured to be coupled with the pole 102 to slide between a lower position in which the umbrella assembly 100 is closed (not shown) and an upper position in which the umbrella assembly 100 is open. As illustrated in FIGS. 2 and 3, in some embodiments, a support structure 112 is disposed on the pole 102. A locking device 114 preferably is mounted on the runner 106. The locking device 114 is configured to engage the support structure 112 to maintain or secure the runner 106 in the upper position and to disengage from the support structure 112 to permit the runner to slide or move from the upper position to the lower position. Preferably, the locking device 114 is configured to maintain or secure the runner 106 in the upper position.

The umbrella assembly 100 can further comprise a plurality of support members connected to the hub 104 and/or runner 106. In some embodiments, the umbrella assembly 100 can comprise a plurality of ribs 116 that can each have a first end 118 and a second end 120. In some embodiments, the first ends 118 of the ribs 116 can be coupled with the upper hub 104 and the second ends 120 disposed away from the upper hub 104. The first ends 118 can be pivotably coupled to the upper hub 104. In some embodiments, the umbrella assembly 100 can further include a plurality of struts 122 that each have a first end 124 and a second end 126. The first ends 124 of the struts 122 can be coupled to the runner 106. The first ends 124 can be pivotably coupled to the runner 106. Additionally, the second ends 126 of the struts 122 can each be coupled to a respective rib of the plurality of ribs 116. In some embodiments, the second ends 126 can be coupled to a connector 128 that is coupled to a rib of the plurality of ribs 116. In some embodiments, the ribs 116 and struts 122 are coupled such that the umbrella assembly 100 forms an umbrella or support frame that can be used to support a canopy. See FIG. 1.

In some embodiments, the runner 106 can have an upper body 152 and a lower body 154. The upper body 152 can be formed with a plurality of protrusions 156 extending radially outward from the center of the upper body 152 of the runner 106. Connection cavities 158 can be formed between the protrusions 156 of the upper body 152. The connection cavities 158 can each be configured to receive or accept a strut of the plurality of struts 122. In some embodiments, the first ends 124 of the struts 122 can be positioned within the connection cavities 158 and pivotably coupled to the protrusions 156 of the upper body 152. The protrusions 156 can have engagement features 160 (e.g., recesses, apertures, protrusions, etc.) configured to engage with corresponding engagement features (not shown) (e.g., recesses, apertures, protrusions, bolts, screws, etc) disposed or formed on the struts 122. In some embodiments, the engagement features 160 can comprise pivot zones 162 formed on interior side surfaces of the protrusions 156 that surround the connection cavities 158 such that the first ends 124 of the struts 122 can be pivotably coupled to the runner 106. The pivot zones 162 can be enclosed or formed by surfaces of the protrusions 156 and cap portion 140 of the runner 106.

In accordance with certain embodiments, this application relates to a way to secure or maintain the runner 106 in the upper or elevated position on the umbrella pole 102 in which the umbrella assembly 100 is open. As noted in the discussion of FIGS. 1-2 above, the runner 106 is configured to be movable along the umbrella pole 102 and is attached by a plurality of struts 122 that extend outwardly and in some cases or configurations upwardly to couple or attach to the plurality of ribs 116 that support a canopy (not shown) of the assembled umbrella. The plurality of ribs 116 are attached to the upper hub 104 at or just beneath the crown 130 of the umbrella pole 102. As discussed above, in some embodiments, a locking device 114 can be mounted on the runner 106. The locking device 114 can be configured to engage the support structure 112 to maintain or secure the runner 106 in the upper position. The locking device 114 can be configured to disengage from the support structure 112 to permit the runner 106 to slide or move from the upper position to the lower position. In some embodiments, the umbrella assembly 100 is closed when the runner 106 is in the lower position on the pole 102.

The support structure 112 disposed on an exterior surface of the umbrella pole 102 can comprise, but is not limited to, a flange, protrusion, ring, engagement feature, step, etc. In some embodiments, the support structure 112 can be a recess or hole formed in the umbrella pole 102. The support structure 112 can comprise a portion of the wall of the umbrella pole and/or a flange or protrusion disposed on an interior surface of the umbrella pole 102 accessible through a recess, hole, recess or aperture in the umbrella pole 102. The support structure 112 is not limited to any specific shape or orientation. The support structure 112 can be a separate component or components attached to the umbrella pole 102 via screw, nail, bolt, adhesive, etc. In some embodiments, the support structure 112 can be monolithically formed with the umbrella pole 102. In some embodiments, the support structure 112 can comprise a lateral dimension, e.g., width or arc that is equal to or less than the width or diameter of a strut 122 and/or connection cavity 158. The support structure 112 can have first and second lateral edges 164, 166 extending substantially parallel to each other along an axis that extends from the top of the umbrella pole 102 to the bottom of the umbrella pole. The lateral dimension of the support structure can be the width or distance between the first and second lateral edges 164, 166.

In accordance with certain embodiments, this application relates to a way to secure or maintain the runner 106 in the upper or elevated position on the umbrella pole 102 in which the umbrella assembly 100 is open. As noted in the discussion of FIGS. 1-2 above, the runner 106 is configured to be movable along the umbrella pole 102 and is attached by a plurality of struts 122 that extend outwardly and in some cases or configurations upwardly to couple or attach to the plurality of ribs 116 that support a canopy (see FIG. 1) of the assembled umbrella. The plurality of ribs 116 are attached to the upper hub 104 at or just beneath the crown 130 of the umbrella pole 102. As discussed above, in some embodiments, a locking device 114 can be mounted on the runner 106. The locking device 114 can be configured to engage the support structure 112 to maintain or secure the runner 106 in the upper position. The locking device 114 can be configured to disengage from the support structure 112 to permit the runner 106 to slide or move from the upper position to the lower position. In some embodiments, the umbrella assembly 100 is closed when the runner 106 is in the lower position on the pole 102.

Figure 4:
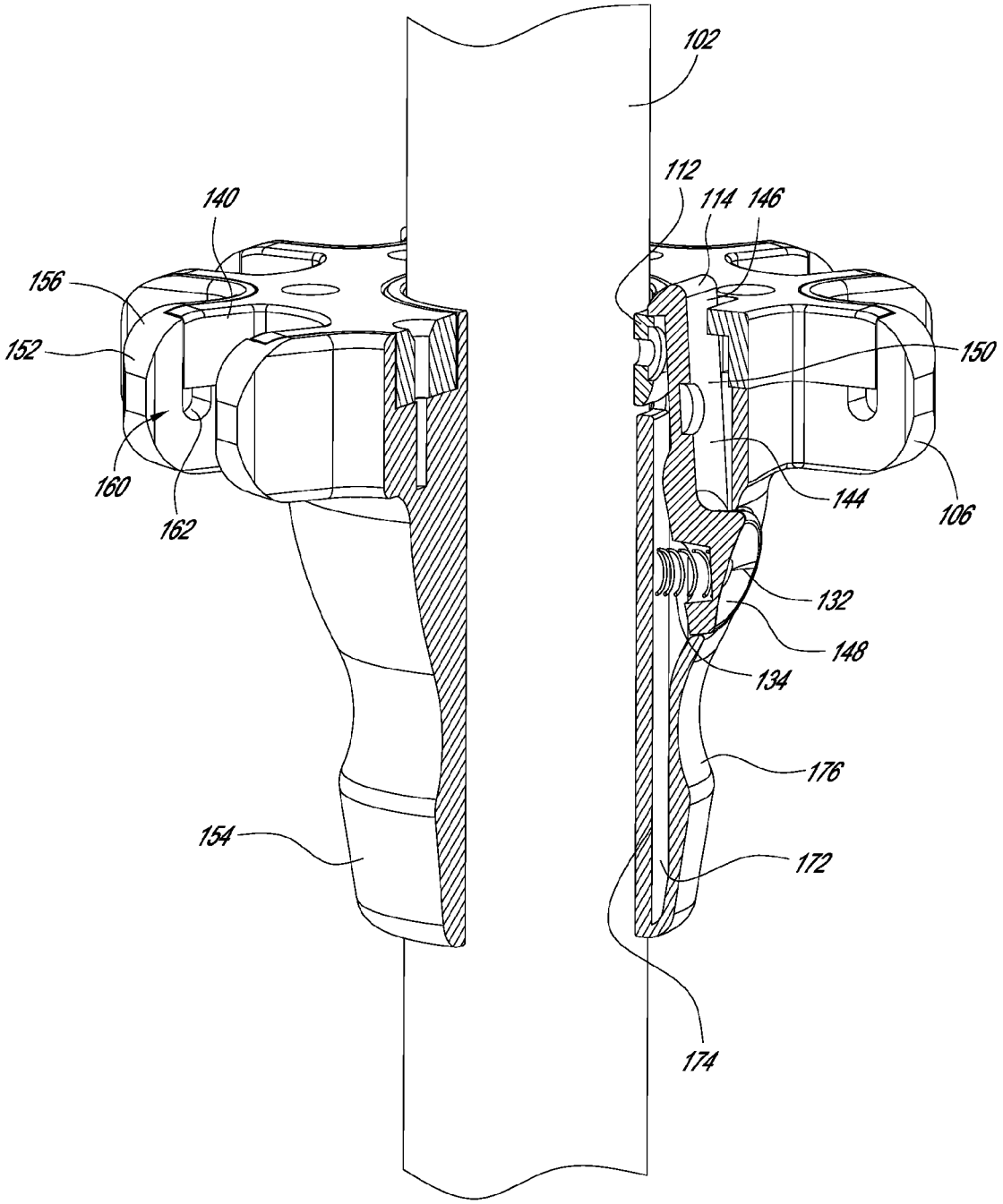
FIG. 4 is a partial cross-sectional view of the runner of FIG. 2.
Figure 5:
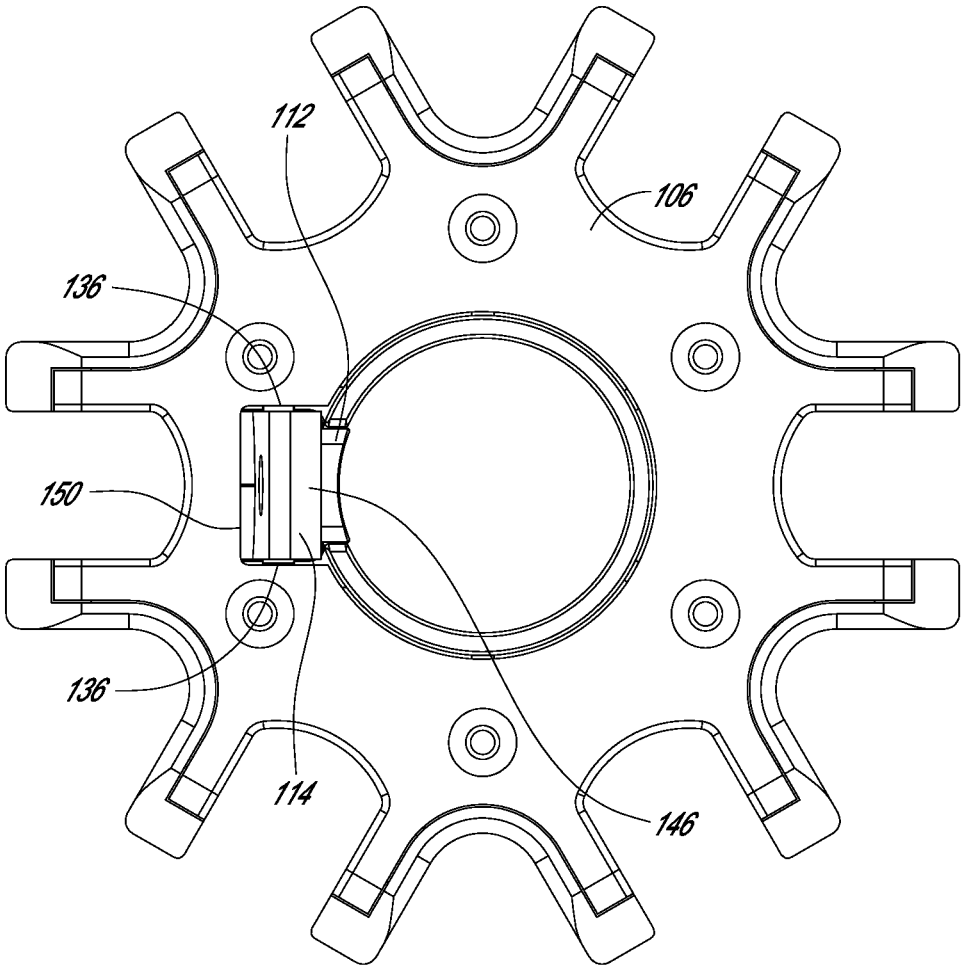
FIG. 5 is a top view of the runner of FIG. 2.

As illustrated in FIG. 3, in some embodiments, the runner 106 can comprise a roof or cap portion 140 configured to be coupled to the top of the upper body 152 of the runner 106 via screws, bolts, or other engagement mechanisms 142. In some embodiments, at least a portion of the locking device 114 (e.g., the body 144, etc) is positioned within a recess 150 formed in the cap portion 140 and upper body 152 of the runner 106 as illustrated in FIGS. 4-5. The locking device 114 can be secured or maintained within the runner 106 in the recess 150 when the runner is assembled. The recess 150 can be sized to enable the upper end 146 of the locking device 114 to move laterally away from the support structure 112 such that it can be engaged and disengaged from the support structure 112. In some embodiments, the width of the recess 150 can be equal to or less than the width of the struts 122 or connection cavities 158 such that it can be positioned in the runner 106 directly behind a connection cavity 158 and/or between engagement mechanisms 142.

As shown in FIG. 3, in some embodiments, the cap portion 140 can comprise a protrusion 168 configured to be received within recess 138 of the runner 106 when coupled to the top of the upper body 152 to enclose the protrusions 136 within the recess 138. The cap portion 140 can also form a portion of or enclose the pivot zone 162 as discussed above of the upper body 152. Thus, in some embodiments, the cap portion 140 can simultaneously enclose or secure both the recess 138 and the pivot zone 162 to retain, maintain, or secure the locking device 114 and the struts 122 or other types of support members within the runner 106 when the cap portion 140 is coupled or assembled to the top of the upper body 152 of the runner 106.

In some embodiments, as illustrated in FIGS. 2-5, the locking device 106 is configured to be actuatable by a user. As discussed above, the locking device 114 is configured to engage with the support structure 112 on the umbrella pole 102. In some embodiments, the engagement can be automatic as the locking device 114 is elevated and ultimately moves above the support structure 112 on the umbrella pole 102 as the runner 106 is moved to the upper position. To unlock or disengage the locking device 114, a force can be applied to the locking device 114. In some embodiments, the locking device 114 can comprise a hook-like member at the upper end 146 that is configured to engage with the support structure 112 and secure the runner 106 in the elevated or upper position.

Further, the locking device 114 can comprise a spring loaded push button member 132 at the lower end 148 that is exposed on an outer surface of the runner 106. In some embodiments, the push button member 132 is positioned on the lower body 154 of the runner 106. The lower body 154 can comprise a window, aperture, recess, or hole 170 formed in the surface of the runner through which the push button member 132 is accessible and/or extends through. In some embodiments, disengaging the locking device 114 from the support feature 112 comprises pressing the button member 132 which compresses spring 134 and pivots or rotates the lower end 148 of the locking device 114 towards the umbrella pole 102 via the one or more protrusions 136. As shown in FIGS. 3-4, spring 134 can be positioned below the protrusions 136 the locking device 114 pivots about on a front surface of the locking device 114 behind the push button member 132 that faces a direction opposite of the surface of the push button member 132 extending through hole 170. However, in other embodiments, the spring 134 can be positioned above the protrusions 136 and/or on a rear surface of the locking device 114. As lower end 148 moves towards the pole 102, the hook-like member at the upper end 146 moves laterally away from the support structure 112 disengaging the locking device 114, such that the runner 106 can be moved to the lower position. The pivoting or fulcrum motion of the locking device 114 enables a user to engage or disengage the upper end 146 from the support structure 112. In some embodiments, the lower end 148 can comprise a hook member or other engagement member configured to engage and disengage from the support structure 112.

As shown in FIG. 4, in some embodiments, the runner comprises a space, recess or cavity 172 formed between an inner wall of exterior surface 176 and an outer wall of inner surface 174 of the runner 106. One end of the spring 134 bears or abuts against the outer wall of inner surface 174 while the other end bears against the front surface of locking device 114 facing towards the interior of the runner such that the locking device 114 can be moved between a contracted and extended position as the spring 134 is biased or un-biased. In some embodiments, the locking device is in the extended or rest position when a force is not applied to the locking device 114 and the contracted position when the a force is applied to bias the spring 134.

The movement of the locking device 114 is not limited to a pivoting motion in order to engage or disengage from the support structure. In some embodiments, the locking device 114 is configured to be slidable (e.g., vertically, horizontally, etc.) or rotatable in order to engage or disengage from the support structure to allow the runner to be moved from the upper to lower or lower to upper positions.

Figure 6:
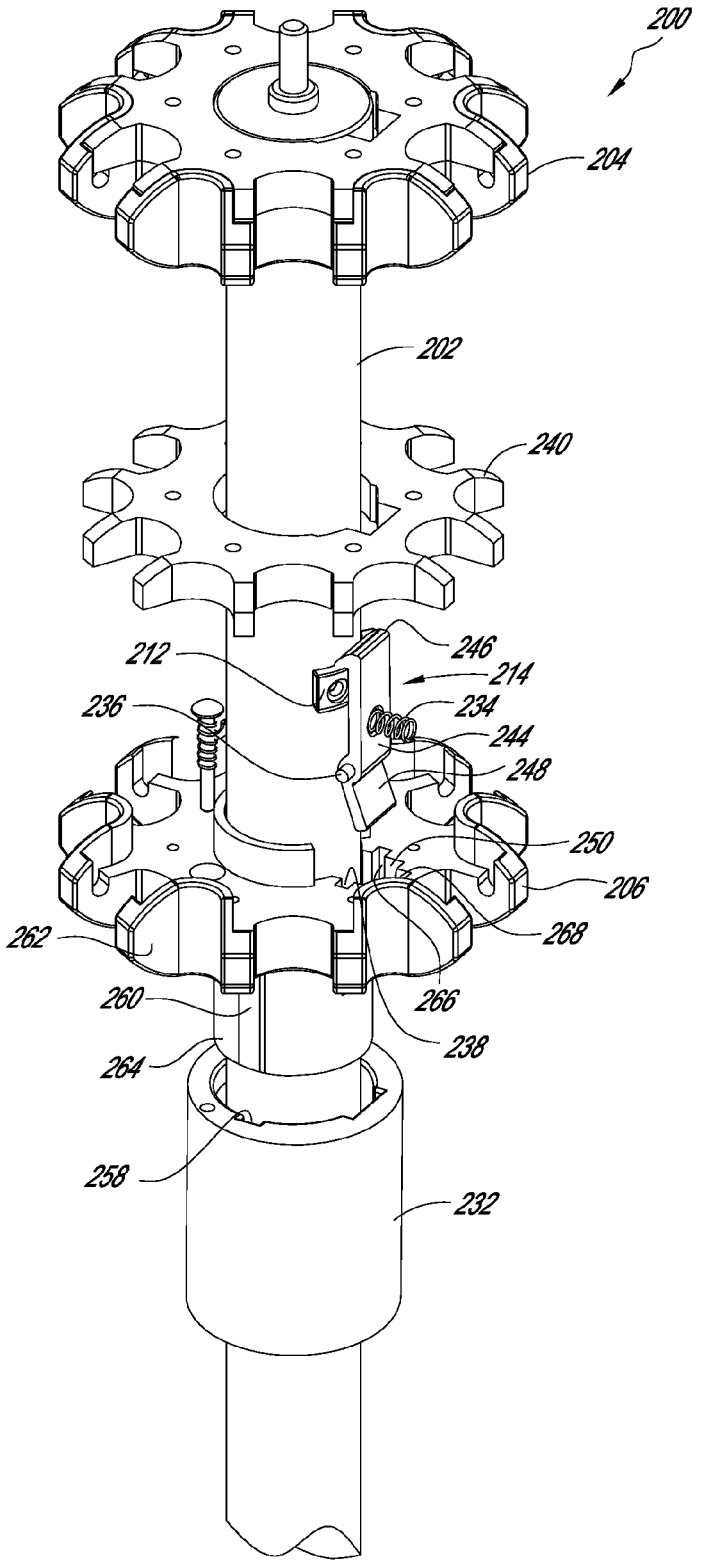
FIG. 6 is an exploded view of another embodiment of a runner assembly including an actuatable locking device to maintain the runner in an elevated position.
Figure 7:
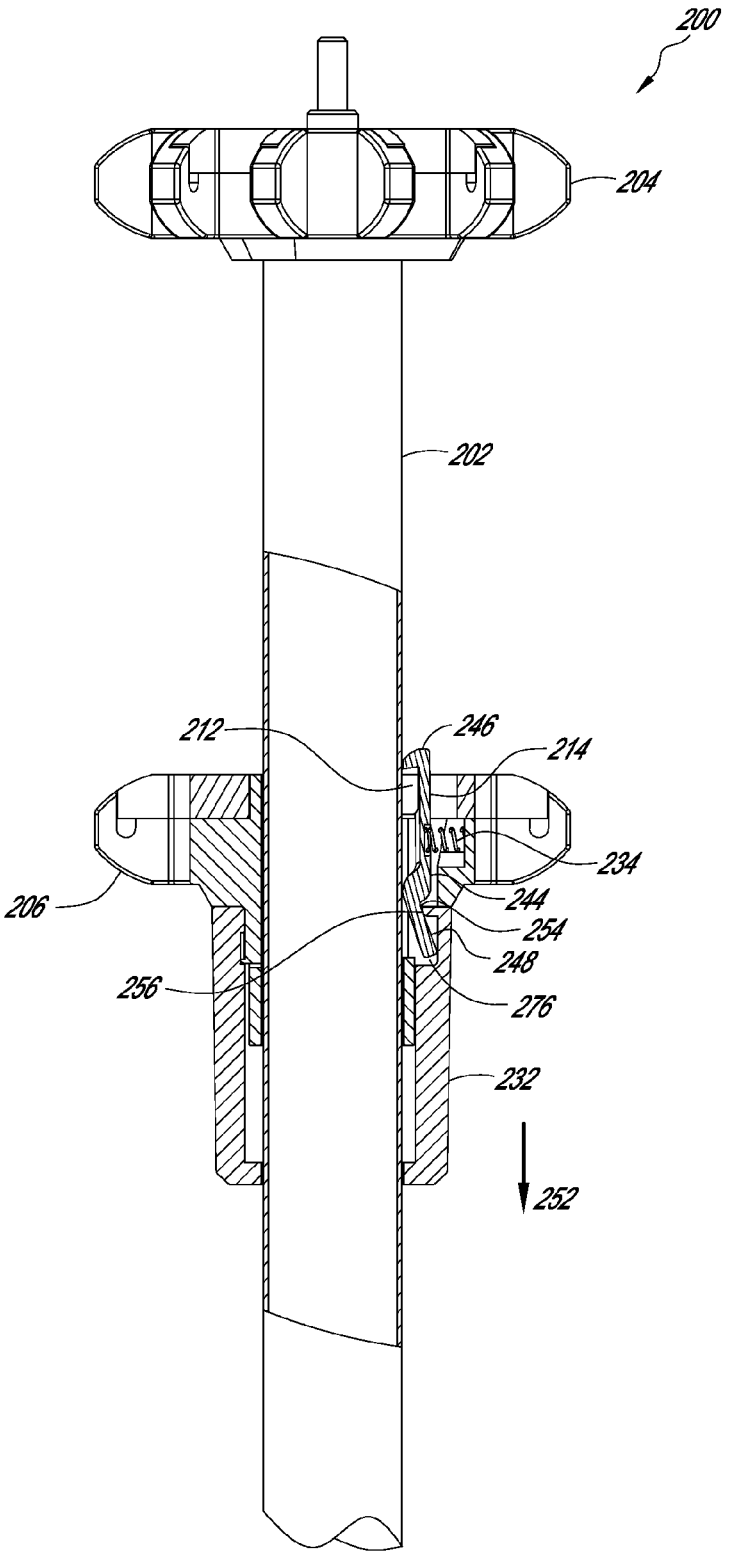
FIG. 7 is a side partial cross-sectional view of a hub and pole assembly for an umbrella, showing a first configuration of the locking device of the runner of FIG. 6.
Figure 8:
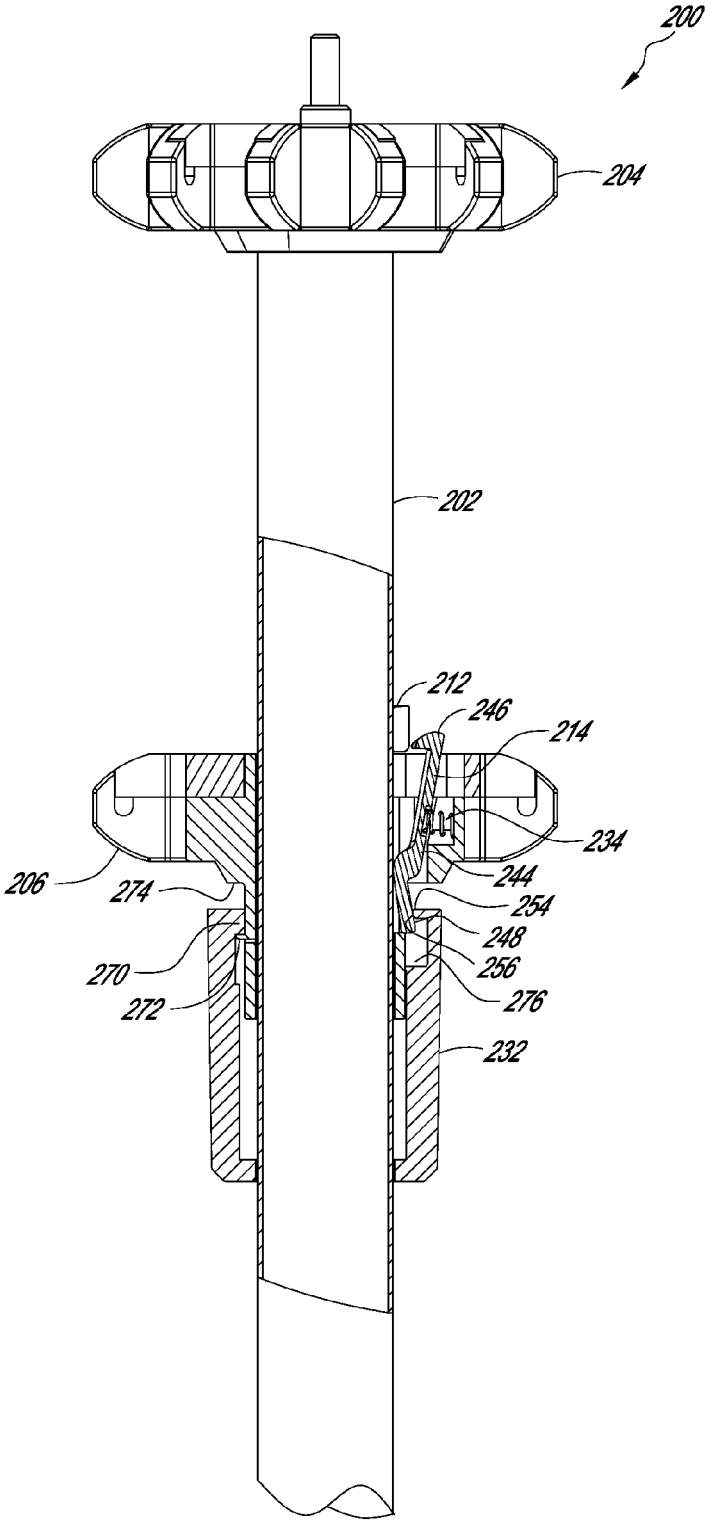
FIG. 8 is a side partial cross-sectional view showing a second configuration of the locking device of the runner of FIG. 6.

In another embodiment, as illustrated in FIGS. 6-8, a separate actuator 232 is provided that is configured to apply force to a locking device 214. The embodiment, as illustrated in FIGS. 6-7, can comprise one or more features of any of the embodiments described herein. For example, umbrella assembly 200 can comprise a pole 202, an upper hub 204 and a lower hub or runner 206. Any of the features of the embodiment illustrated in FIGS. 6-7 can be combined with any of the embodiments described herein. For example, the umbrella assembly 100 can comprise an actuator as described in more detail below.

The actuator 232 can comprise, but is not limited to, a collar, sleeve, etc. disposed around the pole 202 and/or over the locking device 214. In some embodiments, a vertical translation of the actuator 232 disengages a hook-like member of the locking device 214 from the support structure 212, which permits the runner 206 to translate down from an upper position to a lower position, allowing the umbrella assembly 200 to be closed. The arrow 252 illustrated in FIG. 7 shows the direction of movement of the actuator 232 as downward in some embodiments. However, in other embodiments, the direction of movement or vertical translation can be upward.

In some embodiments, the movement of the actuator 232 in a downward direction can cause an engagement feature 254 of the actuator 232 to press on or contact a portion 256 of the locking device 214. The locking device 214 can be configured to pivot a hook-like member at the upper end 246 of the locking device 214. The locking device can be configured to pivot via one or more protrusions 236 positioned in corresponding recesses 238, from an engaged position with the supporting structure 212 to a disengaged position as illustrated in FIG. 8. The runner 206 can then be translated down from an upper position to a lower position on the pole 202 such that the umbrella 200 can be closed. In some embodiments, the locking device 214 can comprise a spring 234 attached to the rear surface of the body 244 such that the locking device 214 can be biased on and off the support structure 212. The spring 234 can be positioned above the protrusions 236 the locking device 214 pivots about. However, in some embodiments, the spring 234 can be positioned on a front surface of the body 244 and/or below the protrusions 236. In some embodiments, as illustrated in FIGS. 6-8, the engagement feature 254 (e.g., but not limited to, an inner surface, step and/or protrusion of the actuator 232) can be configured to engage with or abut the portion 256 of the locking device 214 (e.g., but not limited to, a lever, inclined surface, etc.) at a lower end 248 to move the locking device from engaged to disengaged positions.

As shown in FIG. 6, to simplify manufacturing, the hub 204 and runner 206 can comprise many of the same, identical or similar structures and/or components.

In some embodiments, as the actuator 232 is translated in a downward direction, the engagement feature 254 can engage the locking device 214 to move the locking device 214 of the support structure 212 from an engaged position to a disengaged position. In some embodiments, when the actuator 232 is moved downwardly, the engagement feature 254 and the portion 256 of the locking device 214 are configured such that the engagement feature 254 applies an increased lateral force to the portion 256 and when the actuator is moved upwardly, the engagement feature 256 applies a decreased or no force to the portion 256 of the locking device 214. In some embodiments, the actuator 232 can comprise a recess 276 configured to accommodate lateral outward motion and/or lateral inward motion of a lower end or portion 248 of the locking device 214 as a lateral force applied to the portion 256 is increased or decreased. In some embodiments, the actuator 232 can be rotatable in a clockwise or counterclockwise direction to move the locking device from an engaged position to a disengaged position and vice versa.

In some embodiments, the upward and downward range of movement of the runner and/or actuator 232 or "actuation travel limit" can be structurally restricted or limited to prevent the engagement feature 254 from becoming disengaged from a lower end of portion 256 of the locking device 214. As shown in FIGS. 7-8, in some embodiments, an upper portion of the actuator can comprise a protrusion, extended surface, ledge or overhang 270. The runner 206 can comprise upper and/or lower shoulders 274, 272 configured to abut upper and lower surfaces of the overhang 270 of actuator 232 in order to restrict upward or downward movement of the actuator 232. In some embodiments, when an upper surface of the overhang 270 contacts the upper shoulder 274 of the runner, the actuator is restricted or prevented from further upward movement. In some embodiment when the actuator is restricted from further upward movement, the actuator 232 is positioned such that the engagement feature 254 is disposed above the lower end of portion 256. When a lower surface of the overhang 270 contacts the lower shoulder 272 of the runner 206, the actuator is restricted from further downward movement. In some embodiments, when further downward movement is restricted, the actuator 232 is positioned such that the engagement feature 254 is positioned at or below the lower end of portion 256.

In some embodiments, as shown in FIG. 6, the actuator 232 can comprise one or more channels or recesses 258. The recesses 258 can be formed on an interior surface of the actuator 232 and extend substantially parallel to a longitudinal axis of the actuator that extends from a top portion to a bottom portion of the actuator 232. The recesses 258 can be configured to engage with one or more linear guide members or surface such as, but not limited to, raised surfaces, splines, and/or protrusions 260 that can be formed on an exterior surface of a lower body 264 of the runner 206. The linear guide members can be disposed between the actuator 232 and a surface of the runner 206. The engagement of the splines 260 and the recesses 258 can assist in guiding the movement or translation of the actuator 232 downwardly and/or upwardly.

As shown in FIG. 6, in some embodiments, the recess 250 positioned in the lower body 264 of the runner 206 can comprise or be formed by a combination of three or more recesses 266, 238, 268. The recess 250 can be configured with two side recesses 238 formed on opposite sides of a central recess 266 and a rear recess 268 formed on a side extending between the two recesses 238 on a back side of the central recess 266. The body of the locking device 214 can fit within the central recess 266, the protrusions 236 within the side recesses 238, and the spring 234 within the rear recess 268. In some embodiments, the recess 250 can comprise a cross-like configuration.

In some embodiments, the actuator 232 may be preferable relative to a push button member 132 for some users. Additionally, a collar or sleeve surrounding the entire bottom portion of the runner allows a user to actuate the locking device from multiple positions as the actuator can be translated as long as a user can move it downwardly. This may be advantageous in some embodiments over a push button member as a user would be required to be in a position that allows them to push the push button member in the appropriate direction in order to actuate the locking device. Such a configuration can allow a more sleek or aesthetically appeasing locking device as no button is visible on an exterior surface of the runner. Instead, a collar or sleeve positioned around the runner may give the runner and/or umbrella a more sleek look given the continuous and/or integrated look of a collar or sleeve around the runner.

In addition to the foregoing, some embodiments can be directed to any umbrella or umbrella assembly designs with self-locking constructions. These do not require the locking devices 114, 214 of other embodiments described herein (or a cleat or other clamp) to remain in the open position. However, in some embodiments, any of the umbrella or umbrella assemblies described herein can comprise any of the locking devices discussed above or other types of locking devices known in the art or one or more features of any of the embodiments discussed herein. For example, the umbrella or umbrella assemblies can comprise the locking devices as additional, backup, or secondary securing or locking mechanisms.

In some embodiments, the designs can resemble the umbrella assembly 100 in FIG. 1 above, but can be configured with an inflection point along the range of travel of the runner 106. As the runner 106 is pushed or translated upward, forces resisting the upward movement of the runner 106 (e.g., downward net force) can comprise the force of gravity acting on the mass of the ribs 116 and/or struts 122 and any internal friction in the mechanism. At, beyond, or past the inflection point, the forces applied by the ribs 116 and/or struts 122 to the runner 106 invert and are directed upward (e.g., upward net force) and have a magnitude that is sufficient to cause the runner 106 to move by itself (e.g., without application of additional force and/or user interaction) from the inflection point to the upper or elevated position corresponding to the fully open configuration of the umbrella 100. The upward net force 180 is illustrated in FIG. 1 in accordance with certain embodiments herein. The movement of the runner 106 to move by itself from the inflection point to the upper or elevated positioned can be referred to as "self-opening" as reduced or in some cases no application of additional force and/or user interaction is required to reach the fully open configuration of the umbrella 100. In some embodiments, in the fully open configuration of the umbrella 100, first ends 124 of the struts are positioned at an elevation higher than that of the second ends 126 of the struts 122.

For example, in some embodiments, when the runner 106 is moved past the inflection point, a user can release the runner 106, and it will move by itself to the upper or elevated position. In some embodiments, the umbrella 100 can remain in the fully open configuration without the use of an additional locking device, cleat or other clamp. To collapse or close the umbrella 100, the user pulls the runner 106 down from the fully open position to the inflection point, beyond which the force direction again inverts and pushes the runner 106 down to a lowered position corresponding to the fully closed configuration without requiring application of additional force and/or user interaction. In the open configuration, the runner can be elevated and a canopy (not shown) disposed over the ribs can be taught. A closed configuration can correspond to a lower position of the runner.

A "self-opening" umbrella can be simpler to manufacture or install, lighter in weight, and/or require a less complex secondary locking device. In some embodiments, a "self-opening" umbrella advantageously is configured with a locking device such as any of those described herein to prevent inadvertent closing of the umbrella due to high winds or load on top of the umbrella. In some embodiments, a locking device mounted on a runner can be configured to prevent the umbrella from unintentionally switching from the open configuration to the closed configuration. Once the umbrella "self-opens" to the fully open configuration, a user can then latch or hook a simple locking device attached or mounted to the runner 106 to the pole of the umbrella or other support structure positioned on the umbrella such that the runner is retained in the desired location and the umbrella in the fully open configuration. In some embodiments, the locking device is configured to be disposed directly above the support structure and apply little, minimal, and/or substantially no downward force or even contact between the locking device and support structure. But, in the presence of an unplanned or external downward force, such as in the wind, the locking device can engage or apply a greater force to the support structure, which prevents inadvertent collapse of the umbrella. If present, the self-opening type umbrella will enable a lighter, simpler and/or less robust locking device and/or support structure than would be used for supporting the full weight of the umbrella.

For example, in some embodiments, when the runner 106 is moved past the inflection point, a user can release the runner 106, and it will move by itself to the upper or elevated position. In some embodiments, the umbrella 100 can remain in the fully open configuration without the use of an additional locking device, cleat or other clamp. To collapse or close the umbrella 100, the user pulls the runner 106 down from the fully open position to the inflection point, beyond which the force direction again inverts and pushes the runner 106 down to a lowered position corresponding to the fully closed configuration without requiring application of additional force and/or user interaction. In the open configuration, the runner can be elevated and a canopy (see FIG. 1) disposed over the ribs can be taught. A closed configuration can correspond to a lower position of the runner.

What is claimed is:

1. An umbrella, comprising:

a pole having an upper end and a lower end, and extending along a longitudinal axis;

an upper hub coupled with the upper end of the pole;

a runner disposed beneath the upper hub and coupled with the pole to slide between a lower position in which the umbrella is in a closed configuration and an upper position in which the umbrella is an open configuration;

a plurality of support members connected to the hub and runner;

a support protrusion extending outwardly from and rigidly attached to an outside surface of the pole, the support protrusion extending along a direction substantially perpendicular and intersecting the longitudinal axis of the pole; and a locking device pivotally mounted on the runner, the locking device disposed radially inward of an outer periphery of the runner, the locking device comprising an engagement portion extending outwardly and movable toward the pole to engage with the support protrusion to maintain the runner in the upper position and movable away from the pole to disengage from the support protrusion to permit the runner to slide from the upper position to the lower position, the locking device being configured to operate about a pivot axis, the pivot axis being disposed below and extending transversely to the direction of the support protrusion when the engagement portion is engaged with the support protrusion.

2. The umbrella of claim 1, wherein the runner comprises a cap portion configured to secure both the locking device and at least one support member of the plurality of support members within the runner when the cap portion is assembled to the runner.

3. The umbrella of claim 1, wherein the locking device is configured to be pivotally mounted on the runner such that a force applied to one end of the locking device causes another end of the locking device to pivot away from the side of the support structure.

4. The umbrella of claim 3, wherein a collar is provided over the locking device, the collar having an inner surface that engages the locking device to move the locking device between engaged and disengaged positions.

5. The umbrella of claim 4, wherein when the collar moves downwardly the inner surface applies an increased lateral force to the locking device and when the collar moves upwardly the inner surface applies a decreased or no force to the locking device.

6. The umbrella of claim 4, further comprising at least one linear guide surface disposed between the collar and a surface of the runner to guide the movement of the collar relative to the runner.

7. The umbrella of claim 6, wherein the collar includes a recess to accommodate lateral outward motion of a lower portion of the locking device and a collar protrusion configured to apply a lateral inward force on the lower portion of the locking device.

8. The umbrella of claim 7, wherein the collar and/or the runner comprise an actuation travel limit, whereby the movement of the collar is limited to an extent to prevent the lateral force applying collar protrusion from becoming disengaged from a lower end of the lower portion of the locking device.

9. The umbrella of claim 8, wherein the collar comprises an overhang and the runner comprises a shoulder engagement of the overhang and shoulder corresponding to a position of the collar relative to the locking device in which the lateral force applying collar protrusion is disposed above the lower end of the lower portion of the locking device.

10. The umbrella of claim 1, wherein the support members comprises:

a plurality of ribs coupled with the upper hub; and a plurality of struts, each strut extending between and coupled with one of the ribs and the runner;

wherein in the open configuration, the runner is elevated and a canopy disposed over the ribs is extended and inner ends of the struts are coupled with the runner and are disposed at an elevation higher than outer ends of the struts and in the closed configuration, the runner is lowered and the inner end of the struts are disposed at an elevation lower than the outer ends of struts.

11. The umbrella of claim 10, wherein in the open configuration and in the absence of an external downward force, the locking device is disposed directly above the pole protrusion but applies minimal downward force to the pole protrusion.

12. The umbrella of claim 10, wherein in the open configuration and in the absence of an external downward force, the locking device is disposed directly above the pole protrusion but applies substantially no downward force to the pole protrusion.

13. The umbrella of claim 1, wherein the support members comprises:

a plurality of ribs coupled with the upper hub; and a plurality of struts extending between outer ends coupled with the ribs and inner ends coupled with the runner;

wherein the umbrella comprises an open configuration in which the runner is elevated and a canopy is disposed and extended over the ribs and a closed configuration in which the runner is lowered, the inner ends of the struts being disposed at an elevation above the outer ends of the struts when the umbrella is in the open configuration such that the umbrella resists collapsing.

14. An umbrella, comprising:

a pole having an upper end and a lower end;

an upper hub coupled with the upper end of the pole;

a runner disposed beneath the upper hub and coupled with the pole to slide between a lower position in which the umbrella is closed and an upper position in which the umbrella is open, the runner pivotally connected to a plurality of struts at a first location of the runner;

a protrusion extending outwardly from and rigidly attached to a surface of the pole; and a locking device having an actuator pivotally mounted on the runner at a second location, the second location being below the first location, the locking device having an engagement portion at a third location above the first location, the engagement portion configured to engage the protrusion to maintain the runner in the upper position and to disengage from the support structure to permit the runner to slide from the upper position to the lower position, wherein a collar is provided over the locking device, the collar having an inner surface that engages the locking device to move the locking device from engaged to disengaged positions.

15. The umbrella of claim 14, wherein the locking device is configured such that when the collar is translated in a downward direction, the inner surface of the collar applies an increased lateral force to the locking device and when the collar is translated in a substantially upward direction, the inner surface of the collar applies a decreased or no lateral force to the locking device.

16. The umbrella of claim 15, wherein a range of movement of the collar is limited between an upper and lower shoulder of the runner such that upward translation of the collar is prevented upon contact between a surface of the collar and an upper shoulder of the runner and downward translation of the collar is prevented upon contact between a surface of the collar and a lower shoulder of the runner.

17. The umbrella of claim 16, wherein the collar comprises one or more channels configured to engage with one or more guide members disposed on the runner to guide the upward or downward movement of the collar relative to the runner.

* * * * *

UNITED STATES PATENT AND TRADEMARK OFFICE

CERTIFICATE OF CORRECTION

PATENT NO. : 9,113,683 B2
APPLICATION NO. : 13/657344
DATED : August 25, 2015
INVENTOR(S) : Oliver Joen-an Ma It is certified that error appears in the above-identified patent and that said Letters Patent is hereby corrected as shown below:

In the Specification

At Column 3, Line 45, change "(not shown)" to --(see FIG. 1)--.

At Column 4, Lines 14-33, below "166." delete "In accordance with certain embodiments, this application relates to a way to secure or maintain the runner 106 in the upper or elevated position on the umbrella pole 102 in which the umbrella assembly 100 is open. As noted in the discussion of FIGS. 1-2 above, the runner 106 is configured to be movable along the umbrella pole 102 and is attached by a plurality of struts 122 that extend outwardly and in some cases or configurations upwardly to couple or attach to the plurality of ribs 116 that support a canopy (see FIG. 1) of the assembled umbrella. The plurality of ribs 116 are attached to the upper hub 104 at or just beneath the crown 130 of the umbrella pole 102. As discussed above, in some embodiments, a locking device 114 can be mounted on the runner 106. The locking device 114 can be configured to engage the support structure 112 to maintain or secure the runner 106 in the upper position. The locking device 114 can be configured to disengage from the support structure 112 to permit the runner 106 to slide or move from the upper position to the lower position. In some embodiments, the umbrella assembly 100 is closed when the runner 106 is in the lower position on the pole 102.".

At Column 5, Line 52, change "the a" to --a--.

At Column 8, Line 46, change "(not shown)" to --(see FIG. 1)--.

At Column 9, Lines 9-23, below "umbrella." delete "For example, in some embodiments, when the runner 106 is moved past the inflection point, a user can release the runner 106, and it will move by itself to the upper or elevated position. In some embodiments, the umbrella 100 can remain in the fully open configuration without the use of an additional locking device, cleat or other clamp. To collapse or close the umbrella 100, the user pulls the runner 106 down from the fully open position to the inflection point, beyond which the force direction again inverts and pushes the runner 106 down to Signed and Sealed this
Third Day of May, 2016

Michelle K. Lee

Michelle K. Lee
*Director of the United States Patent and Trademark Office* a lowered position corresponding to the fully closed configuration without requiring application of additional force and/or user interaction. In the open configuration, the runner can be elevated and a canopy (see FIG. 1) disposed over the ribs can be taught. A closed configuration can correspond to a lower position of the runner.”.